US005749399A

United States Patent [19]

Reyes Zorrilla

[11] Patent Number: 5,749,399

[45] Date of Patent: May 12, 1998

[54] END SECTIONS OF CONNECTIONS FOR MINERAL WOOL CONDUITS OF THE "CLIMAVER PLUS" TYPE

[75] Inventor: Juan A. Reyes Zorrilla, Madrid, Spain

[73] Assignee: Isover Saint-Gobain, Cedex, France

[21] Appl. No.: 849,956

[22] PCT Filed: Sep. 20, 1996

[86] PCT No.: PCT/ES96/00183

§ 371 Date: May 22, 1997

§ 102(e) Date: May 22, 1997

[87] PCT Pub. No.: WO97/11319

PCT Pub. Date: Mar. 27, 1997

[30] Foreign Application Priority Data

Sep. 22, 1995 [ES] Spain ..... 9502440 U

[51] Int. Cl.[6] ..... F16L 9/22

[52] U.S. Cl. ..... 138/155; 138/120; 138/149; 405/134; 405/153

[58] Field of Search ..... 138/155, 120, 138/149, 157; 52/712, 715; 285/424; 405/134, 135, 153, 126

[56] References Cited

U.S. PATENT DOCUMENTS

| | | | |
|---|---|---|---|
| 1,992,763 | 2/1935 | Penny et al. | 138/155 |
| 3,805,845 | 4/1974 | Santoro | 138/155 X |
| 4,241,762 | 12/1980 | Link et al. | 138/155 X |
| 4,280,536 | 7/1981 | Gnant | 138/149 |
| 4,304,423 | 12/1981 | Mez | 285/424 X |
| 4,566,724 | 1/1986 | Arnoldt et al. | 285/364 |
| 4,815,895 | 3/1989 | Purssey et al. | 138/155 X |
| 5,460,206 | 10/1995 | Sansoucy | 138/149 |

FOREIGN PATENT DOCUMENTS

| | | | |
|---|---|---|---|
| 2 221 140 | 11/1973 | Germany . | |
| 197811 | 11/1978 | Germany | 138/135 |
| WO 93/11327 | 6/1993 | WIPO . | |

*Primary Examiner*—Patrick F. Brinson

*Attorney, Agent, or Firm*—Cowan, Liebowitz & Latman, P.C.; Michael I. Wolfson

[57] ABSTRACT

A shaping member for the finishing of junctions for "Climaver Plus" type glass wool piping comprising a unitary flat plate of bendable material which can be folded into sections to form a shape such that the shaping member can be placed at the junction of two glass wool elements.

6 Claims, 1 Drawing Sheet

END SECTIONS OF CONNECTIONS FOR MINERAL WOOL CONDUITS OF THE "CLIMAVER PLUS" TYPE

PURPOSE OF THE INVENTION

These Specifications refer to an application for a model of utility concerning the shaping of junction finishes for "Climaver Plus" type glass wool piping, clearly designed for use as finishing units for the ends of the glass wool shapes.

1. Field of the Invention

This invention applies in the metal shape manufacturing industry.

2. Background of the Invention

Self-supporting glass or mineral wool pipes commonly used to make air conditioning piping are cut and joined together to follow the outlines of building walls and ceilings.

At such junctions between the pipes, the air flow raises the inside edge of the pipe and eventually lifts and removes the mineral wool, to the serious detriment of the air flow, which is thus reduced and so impairs the cooling or heating of the premises.

The obvious solution to this problem at present would be to provide a component specifically preventing those anomalies.

The applicant is at present unaware of the existence of any device, element or shape which avoids this problem.

DESCRIPTION OF THE INVENTION

The shaping of junction finishes for "Climaver Plus" type glass wool piping proposed in the invention is of itself a clear novelty within its field of action since, once incorporated into glass or mineral wool air piping or self-carried type piping, the anomalies referred to above are avoided.

More specifically, the shaping for the finish to junctions for "Climaver plus" type glass wool piping which is the subject of the invention is manufactured from a shape which can vary but which will, in general, be fundamentally long, where there are two similar areas made by folding an aluminium or other metal strip into a 90° angle at the top and extending horizontally where, immediately at the end of said horizontal area, it is shaped in the opposite direction, and adapting to the lower part of said horizontal area, to emerge from the upper vertical section from the other side, thereby forming an area of junction between the two different mineral or glass wool elements, added at the point where they are joined, and avoiding the anomalies created by the air flow with the lifting of the wool linings which spoil the flow in the interior of the piping.

In summary, the shape obtained by folding an aluminium or similar metal plate takes the form of a double right angle in opposite positions, with a protruding skirt at right angles to the two vertical extensions, precisely acting as the point of junction of panels made of glass or mineral wool to form tubular piping for air conditioning applications, specifically as pipes through which the air delivered to the various areas flows.

Clearly, the shape can be adapted to any form which may be deemed appropriate, with small modifications in order to connect the panels used to make the piping.

DESCRIPTION OF THE DRAWINGS

To complement the description being given and in order to assist in a better understanding of the features of the invention, these Specifications are accompanied by a sheet of drawings, forming an integral part hereof and which, by way of illustration and without limitation, show the following.

A PREFERENTIAL EMBODIMENT OF THE INVENTION

Figure 1:
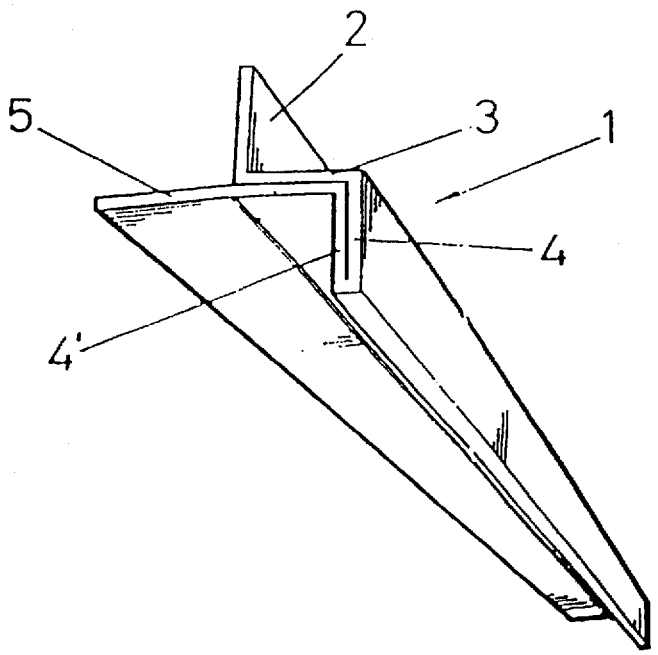
FIG. 1 is a perspective view of the subject of the invention concerning junction finish shaping for "Climaver Plus" glass wool piping.

These illustrations show how the shaping for finishing "Climaver Plus" type glass wool piping junctions put forward comprises a body (1) of undefined length, preferably made of aluminium or some other metal, on a suitably folded plate, with a vertical upper area (2) of rectangular ground plan form, and with a lateral prolongation (3) which is also rectangular, with which element (2) forms a 90° angle: a vertical extension (4) emerges from the finishing line of zone (3) which, at its own finishing line, is deformed and then folded into a vertical upward direction to create an area (4) which is further shaped into a 90° angle to partially back on to the lower surface of the area (3), and with a similar area emerging from the opposite part, to form a wing extension.

Figure 2:
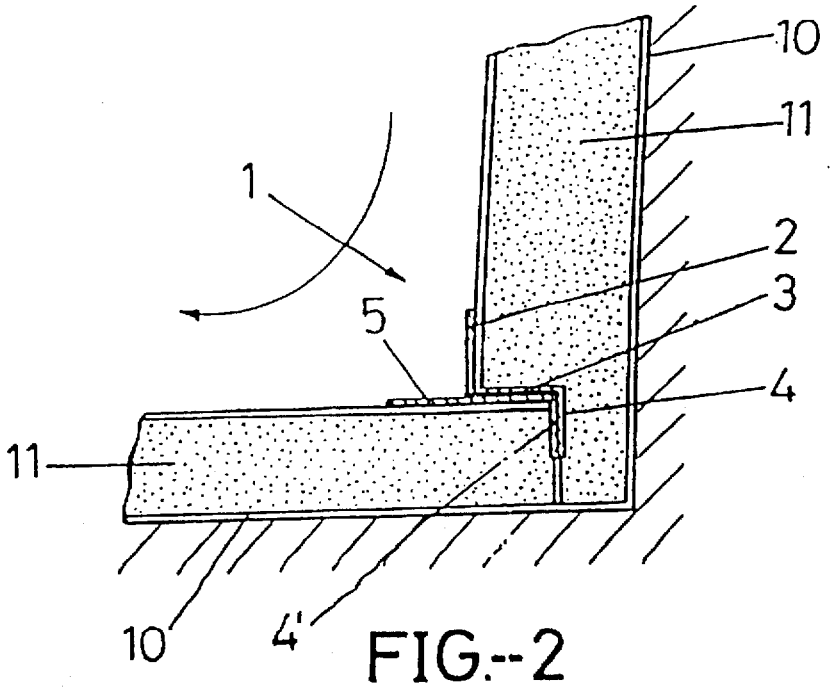
FIG. 2 shows the way in which the component illustrated in FIG. 1 is coupled on glass or mineral wool panels.

FIG. 2 shows clearly how that configuration, illustrated in FIG. 1, fits perfectly between two elements (10) made as components for forming pipes, made of mineral wool (11) and located between the bodies (10) holding it up. This illustration shows how the areas (2) and (3) fit to one of the areas of said body (10) while the sides (4) and (4)' are secured between two elements (10), with the emergence of the wing extension (5), and fitting on to the inside surface of the pipe, together with the element (2).

No further description is considered necessary to enable any expert in the field to grasp the scope of the invention and the advantages arising from it.

The materials, shape, size and layout of the elements may vary, provided that this does not alter the essential nature of the invention.

The terms of these specifications must be understood in all cases broadly, without limitation.

I claim:

1. A shaping member for the finishing of junctions for "Climaver Plus" type glass wool piping manufactured using a unitary flat metal plate that is folded to form a vertical zone (2) of rectangular ground plan, the lower area of which has a horizontal wing section (3) which is also rectangular, at a 90° angle to the element (2), from whose exterior a rectangular extension emerges (4) away from vertical zone (2) at a 90° angle to said section (3), the inside of said extension (4) having an area (4') of similar size which backs on to the inside surface thereof, the upper part of which forms a 90° angle turn away from area (4') and runs in a horizontal direction, forming a zone (5) which backs partially on to the inside surface of the rectangular area (3), with a similar external zone emerging which is also of rectangular ground plan.

2. A shaping member for the finishing of junctions for "Climaver Plus" type glass wool piping, comprising:

a unitary flat plate of a bendable material;

the flat plate folded along an elongated first fold line to form a first vertical section (2) with the lower area of forming a horizontal wing section (3) having a vertical extension (4) which is folded back to form a section (4') against the surface of extension section (4) and is folded horizontally to back against the lower surface of horizontal wing section (3) and extending horizontally beyond vertical section (2) and first fold line;

whereby said shaping member can be placed at the junction of two glass wool elements with said sections (3), (4) and (4') and said proximal portion of section (5) being situated between said glass wool elements, and with said section (2) and said distal portion of section (5) being situated outside said joined glass wool elements.

3. The shaping member of claim 2, wherein said unitary, flat plate is rectangular in shape.

4. The shaping member of claim 2, wherein said unitary, flat plate is made of a bendable metal.

5. The shaping member of claim 4, wherein the metal is aluminum.

6. The shaping member of claim 3, wherein said sections (2), (3), (4), (4') and (5) all have substantially-rectangular cross-sectional shapes.

* * * * *